US009050711B1

(12) United States Patent
Mazzarella

(10) Patent No.: US 9,050,711 B1
(45) Date of Patent: Jun. 9, 2015

(54) MULTIPLE USE FITTERS TOOL ASSEMBLY

(71) Applicant: Thomas E. Mazzarella, Queens, NY (US)

(72) Inventor: Thomas E. Mazzarella, Queens, NY (US)

( * ) Notice: Subject to any disclaimer, the term of this patent is extended or adjusted under 35 U.S.C. 154(b) by 271 days.

(21) Appl. No.: 13/866,454

(22) Filed: Apr. 19, 2013

(51) Int. Cl.
*B25B 7/22* (2006.01)
*B25B 7/04* (2006.01)
*B25F 1/00* (2006.01)

(52) U.S. Cl.
CPC ... *B25B 7/22* (2013.01); *B25B 7/04* (2013.01); *B25F 1/003* (2013.01)

(58) Field of Classification Search
CPC ..... B25B 7/04; B25B 7/22; B25F 1/003
USPC ..... 7/126, 127
See application file for complete search history.

(56) References Cited

U.S. PATENT DOCUMENTS 4,905,550 A * 3/1990 Albrecht ..... 81/185.1
5,251,353 A * 10/1993 Lin ..... 7/128
5,280,659 A 1/1994 Park
5,345,636 A 9/1994 Lamons
5,432,968 A * 7/1995 Beck ..... 7/128
5,485,770 A * 1/1996 Popelak ..... 81/423
D422,845 S 4/2000 Wonder
6,493,892 B2 12/2002 Kang
6,691,357 B2 2/2004 Rivera
7,162,758 B2 1/2007 Skinner
7,334,502 B1 * 2/2008 Durkee ..... 81/20
7,997,170 B1 8/2011 Martinez et al.
D652,278 S 1/2012 Likar
8,166,850 B2 * 5/2012 Caniparoli et al. ..... 81/427.5
2003/0019045 A1 1/2003 Ping

* cited by examiner

*Primary Examiner* — David B Thomas

(57) ABSTRACT

A multiple use fitters tool assembly provides multiple tools used by pipe fitters in a single convertible unit. The assembly includes a pair of elongated arms pivotally coupled together defining an upper handle, a lower handle, an upper jaw, and a lower jaw defining a pipe wrench. A tool slot extends into the pipe wrench. Each of a plurality of extendable tools is pivotally coupled to the pipe wrench in the tool slot and pivotable between an extended use position and a storage position. Selectable pairs of first and second gripping surfaces are couplable to the upper jaw and the lower jaw. A storage void extends into the pipe wrench. Each of the first gripping surfaces and the second gripping surfaces is selectively couplable to the pipe wrench in the storage void when not coupled to the upper jaw and the lower jaw.

11 Claims, 5 Drawing Sheets

MULTIPLE USE FITTERS TOOL ASSEMBLY

BACKGROUND OF THE DISCLOSURE

Field of the Disclosure

The disclosure relates to hand tool devices and more particularly pertains to a new hand tool device for providing multiple tools used by pipe fitters in a single convertible unit.

SUMMARY OF THE DISCLOSURE

An embodiment of the disclosure meets the needs presented above by generally comprising a pair of elongated arms pivotally coupled together defining an upper handle, a lower handle, an upper jaw, and a lower jaw defining a pipe wrench. A tool slot extends into the pipe wrench. Each of a plurality of extendable tools is pivotally coupled to the pipe wrench in the tool slot and pivotable between an extended use position and a storage position. Selectable pairs of first and second gripping surfaces are couplable to the upper jaw and the lower jaw. A storage void extends into the pipe wrench. Each of the first gripping surfaces and the second gripping surfaces is selectively couplable to the pipe wrench in the storage void when not coupled to the upper jaw and the lower jaw.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
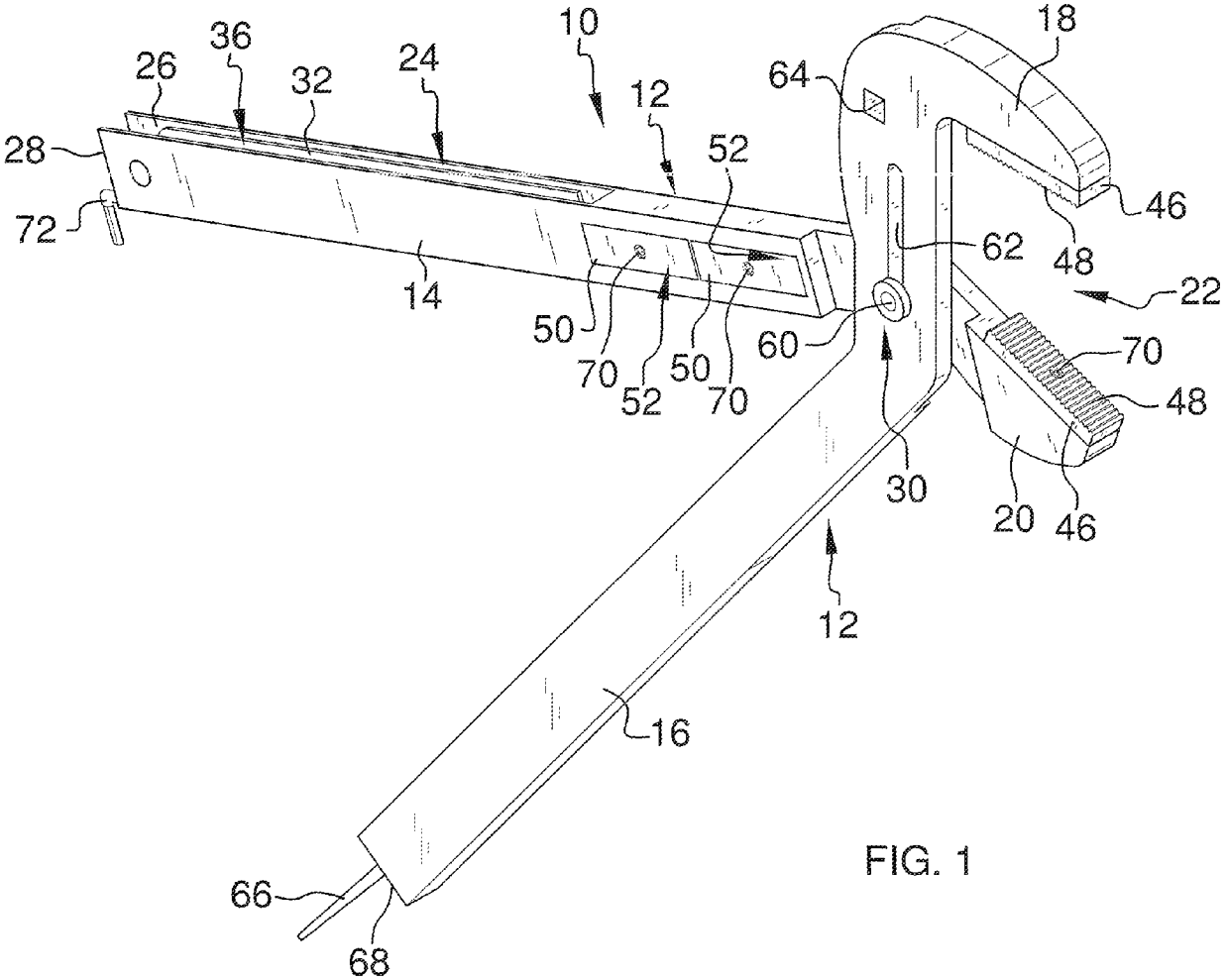
FIG. 1 is a top front side perspective view of a multiple use fitters tool assembly according to an embodiment of the disclosure.
Figure 2:
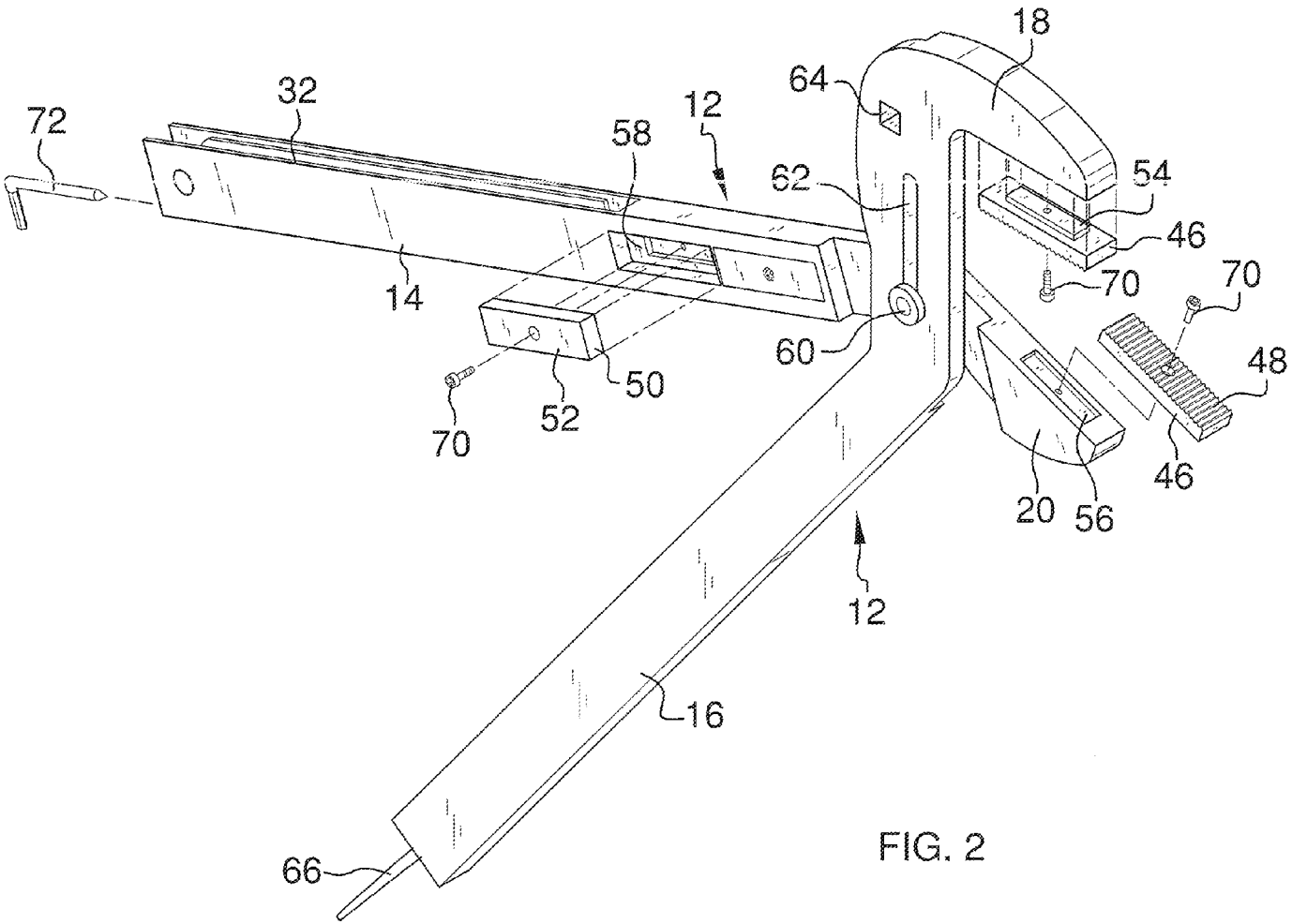
FIG. 2 is a partially exploded top front side perspective view of an embodiment of the disclosure.
Figure 3:
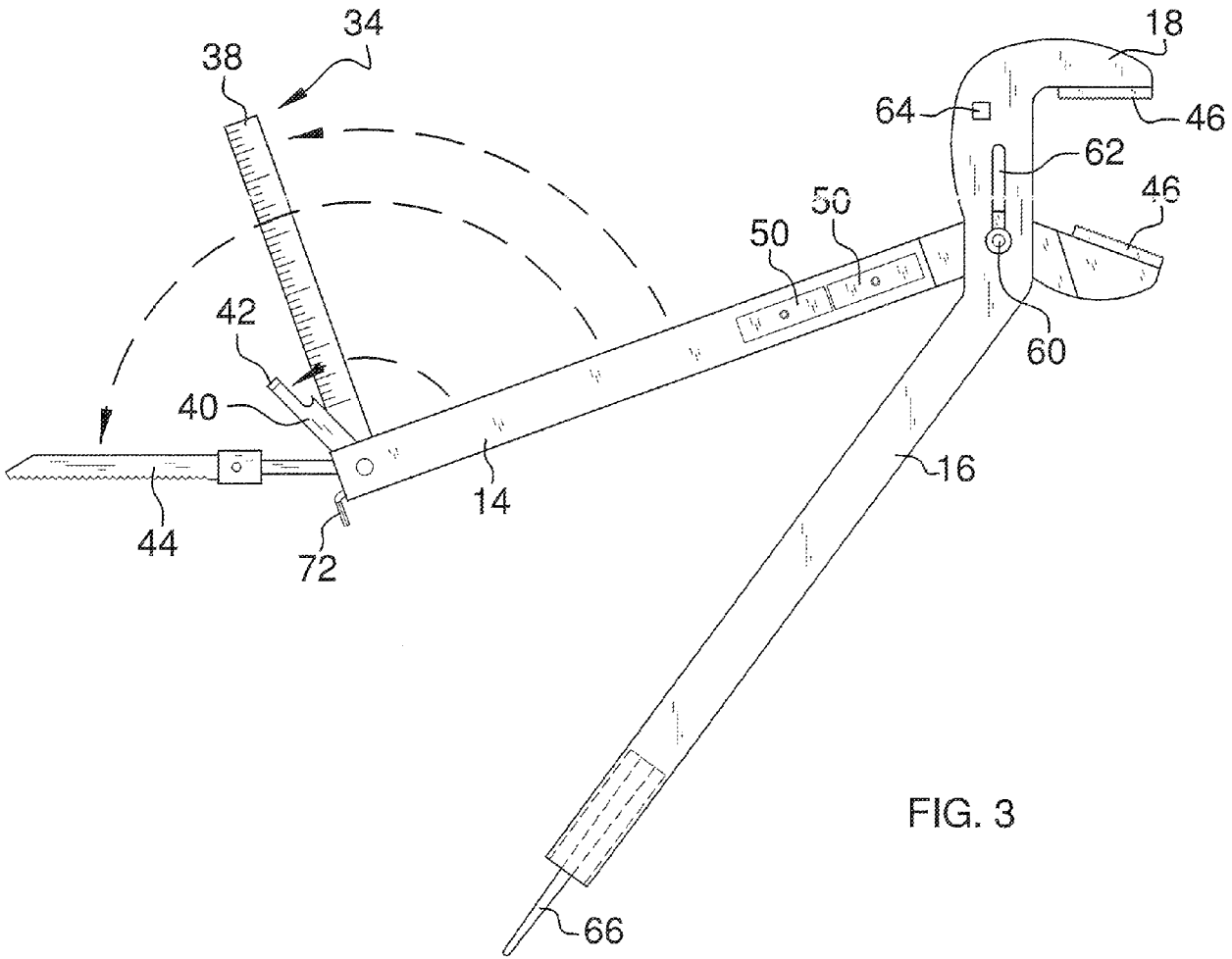
FIG. 3 is a side view of an embodiment of the disclosure.
Figure 4:
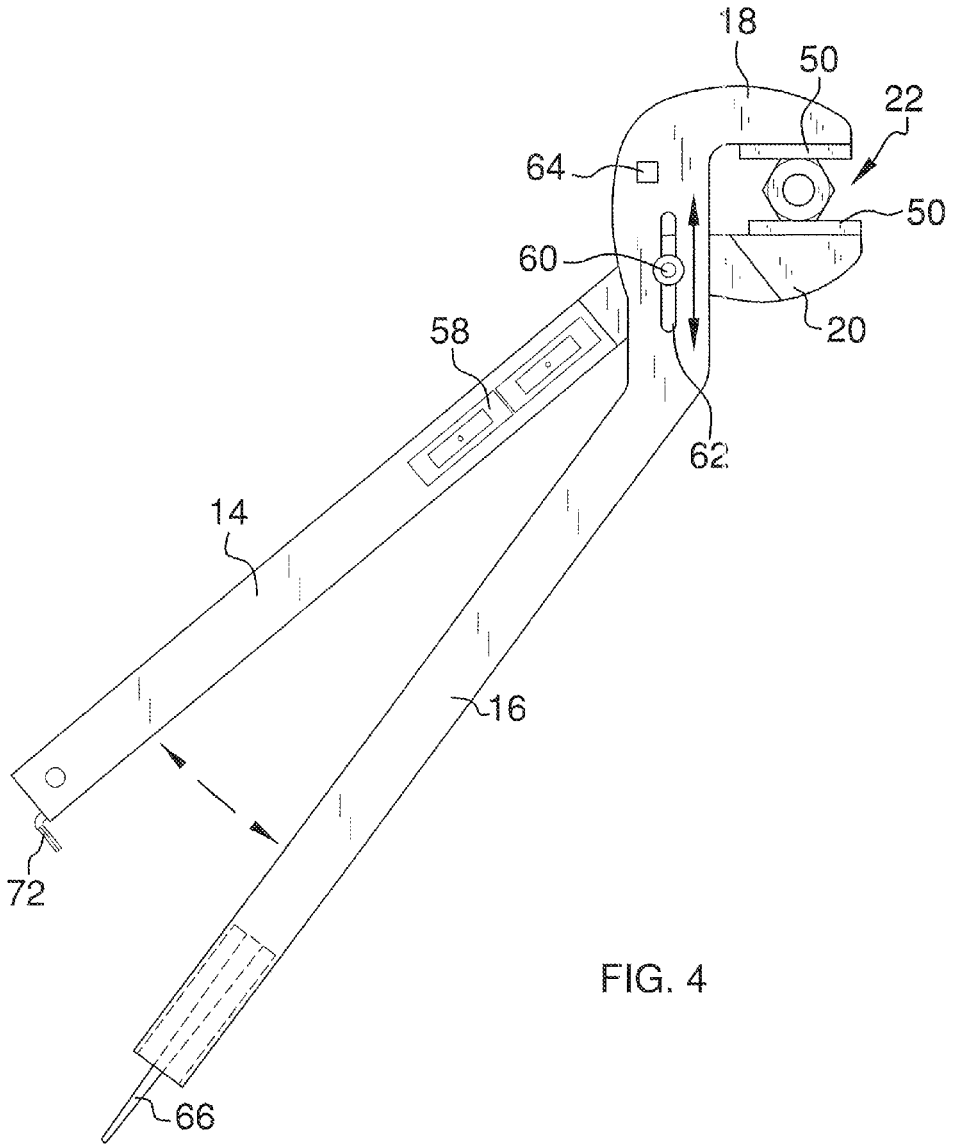
FIG. 4 is a side view of an embodiment of the disclosure.
Figure 5:
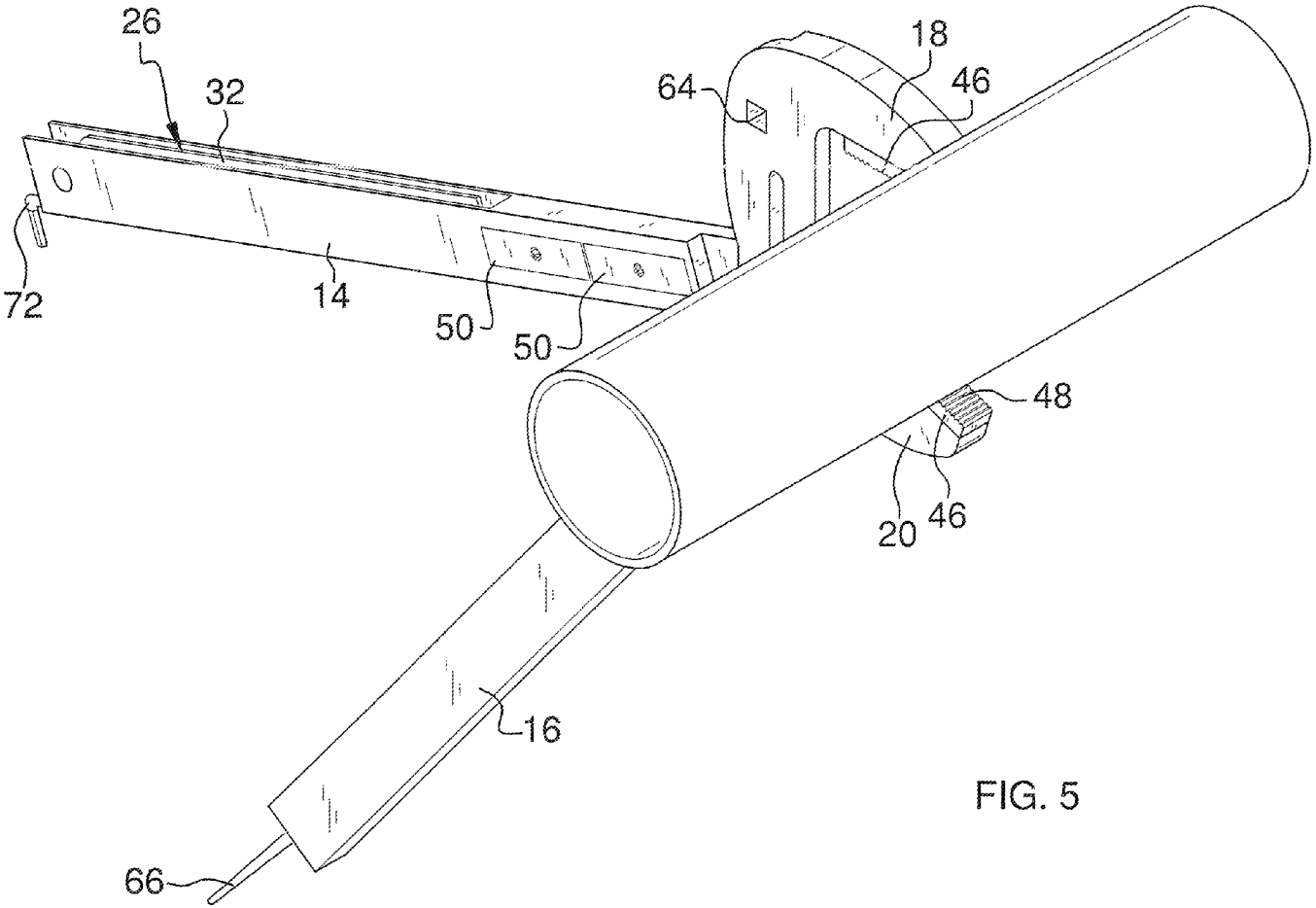
FIG. 5 is a top front side perspective view of an embodiment of the disclosure.

With reference now to the drawings, and in particular to FIGS. 1 through 5 thereof, a new hand tool device embodying the principles and concepts of an embodiment of the disclosure and generally designated by the reference numeral 10 will be described.

As best illustrated in FIGS. 1 through 5, the multiple use fitters tool assembly 10 generally comprises a pair of elongated arms 12 pivotally coupled together defining an upper handle 14, a lower handle 16, an upper jaw 18, and a lower jaw

20 defining a pipe wrench 22. The upper jaw 18 and lower jaw 20 may be angled relative to the upper handle 14 and lower handle 16 in conventional fashion. A pivot pin 60 couples the arms 12 together. An adjustment slot 62 extends through one of the arms 12. The pivot pin 60 is coupled to the other of the arms 12 and extends through the adjustment slot 62 wherein a distance between the upper jaw 18 and the lower jaw 20 is adjustable in conventional fashion for pipe wrenches.

A cavity 24 extends into the pipe wrench 22 defining a tool slot 26. The cavity 24 extends into the upper handle 14. The cavity 24 extends into a distal end 28 of the upper handle 14 relative to a junction 30 of the arms 12. A plurality of extendable tools 32 is pivotally coupled to the pipe wrench 22. Each extendable tool 32 is pivotable between an extended use position 34 wherein the tool 32 extends outwardly from the pipe wrench 22 and a storage position 36 wherein the tool 32 is positioned in the tool slot 26. The extendable tools 32 may include a ruler 38, a bottle opener 40, a flat head screw driver 42, and a jigsaw blade 44. The ruler 38 may also be used in combination with the upper handle 14 as a squaring tool. Indicia may be provided on the ruler 38 to facilitate positioning of the ruler 38 at a desired angle relative to the upper handle 14. The jigsaw blade 44 may be selectively removable from a receiver to permit selection of a desired blade type for cutting through a specific material.

A pair of first gripping surfaces 46 is provided. Each of the first gripping surfaces 46 is selectively couplable to an associated one of the upper jaw 18 and the lower jaw 20. The first gripping surfaces 46 may have a ridged outer surface 48. A pair of second gripping surfaces 50 is also provided. Each of the second gripping surfaces 50 is selectively couplable to an associated one of the upper jaw 18 and the lower jaw 20 to replace the first gripping surfaces 46 if desired. The second gripping surfaces 50 may have a smooth outer surface 52. Each of the first and second gripping surfaces 46,50 may have a projection 54 insertable into a seat 56 in each of the upper jaw 18 and the lower jaw 20 to hold the gripping surfaces 46,50 in place during use. A storage void 58 extends into the pipe wrench 22. The storage void 58 may extend into the upper handle 14 between the tool slot 26 and the junction 30 of the arms 12. Each of the first gripping surfaces 46 and the second gripping surfaces 50 is selectively couplable to the pipe wrench 22 in the storage void 58 when not coupled to the upper jaw 18 and the lower jaw 20. When positioned in the storage void 58, the outer surfaces 48,52 may be flush and coplanar with an outer surface of the upper handle 14. A plurality of connectors 70 is provided. Each connector 70 couples an associated one of the first gripping surfaces 46 and the second gripping surfaces 50 to the pipe wrench 22 in the positions described above. A driving tool 72 such as an allen head wrench, bit, or the like is removably coupled to the pipe wrench 22. The driving tool 72 is engageable to a selectable one of the connectors 70 for coupling and uncoupling the first gripping surfaces 46 and the second gripping surfaces 50 to the pipe wrench 22. When attached, the connector 70 is inset relative to the respective outer surface 48,52 to prevent contact between the connector 70 and a work piece surface abutting the outer surface 48,52.

A square aperture 64 extends into the pipe wrench 22 wherein the pipe wrench 22 is configured for engaging and opening a square projection from an oxygen tank of the type commonly used by fitters. The square aperture 64 may positioned on the upper jaw 18 of the pipe wrench 22 to facilitate grasping the handles 14,16 while using the square aperture 64. A bull pin 66 may be coupled to and extend from a distal end 68 of either one of the upper handle 14 and the lower handle 16 relative to the upper and lower jaws 18,20. The bull pin 66 is tapered extending away from the pipe wrench 22. As shown, the bull pin 66 is coupled to and extends from the lower handle 14. The bull pin 66 may be tapered to provide a range of 0.125 inches to 0.875 inches and is used in conventional fashion to facilitate alignment of holes for riveting and fastening.

In use, the assembly 10 provides a compact combination of multiple tools commonly used by pipe fitters including storage of selectable desired gripping surfaces 46,50 for the upper jaw 18 and lower jaw 20. The extendable tools 32 may be extended and utilized as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A multiple use fitter tool assembly comprising:

a pair of elongated arms pivotally coupled together defining an upper handle, a lower handle, an upper jaw, and a lower jaw defining a pipe wrench;

a cavity extending into said pipe wrench defining a tool slot;

a plurality of extendable tools pivotally coupled to said pipe wrench, each said extendable tool being pivotable between an extended use position wherein said tool extends outwardly from said pipe wrench and a storage position wherein said tool is positioned in said tool slot;

a pair of first gripping surfaces, each of said first gripping surfaces being selectively couplable to an associated one of said upper jaw and said lower jaw;

a pair of second gripping surfaces, each of said second gripping surfaces being selectively couplable to an associated one of said upper jaw and said lower jaw; and a storage void extending into said pipe wrench, each of said first gripping surfaces and said second gripping surfaces being selectively couplable to said pipe wrench in said storage void when not coupled to said upper jaw and said lower jaw.

2. The assembly of claim 1, further comprising a square aperture extending into said pipe wrench wherein said pipe wrench is configured for engaging and opening an oxygen tank.

3. The assembly of claim 2, further comprising said square aperture being positioned on said upper jaw of said pipe wrench.

4. The assembly of claim 1, further comprising:

a pivot pin coupling said arms together; and an adjustment slot, said pivot pin extending through said adjustment slot wherein a distance between said upper jaw and said lower jaw is adjustable.

5. The assembly of claim 1, further comprising a bull pin coupled to and extending from a distal end of one of said upper handle and said lower handle relative to said upper and lower jaws.

6. The assembly of claim 5, further comprising said bull pin being tapered extending away from said pipe wrench.

7. The assembly of claim 6, further comprising said bull pin being coupled to and extending from said lower handle.

8. The assembly of claim 1, further comprising said extendable tools including a ruler, a bottle opener, a flat head screw driver, and a jigsaw blade.

9. The assembly of claim 1, further comprising a plurality of connectors, each connector coupling an associated one of said first gripping surfaces and said second gripping surfaces to said pipe wrench.

10. The assembly of claim 9, further comprising a driving tool removably coupled to said pipe wrench, said driving tool being engageable to a selectable one of said connectors for coupling and uncoupling said first gripping surfaces and said second gripping surfaces to said pipe wrench.

11. A multiple use fitter tool assembly comprising:

a pair of elongated arms pivotally coupled together defining an upper handle, a lower handle, an upper jaw, and a lower jaw defining a pipe wrench;

a cavity extending into said pipe wrench defining a tool slot, said cavity extending into said upper handle, said cavity extending into a distal end of said upper handle relative to a junction of said arms;

a plurality of extendable tools pivotally coupled to said pipe wrench, each said extendable tool being pivotable between an extended use position wherein said tool extends outwardly from said pipe wrench and a storage position wherein said tool is positioned in said tool slot, said extendable tools including a ruler, a bottle opener, a flat head screw driver, and a jigsaw blade;

a pair of first gripping surfaces, each of said first gripping surfaces being selectively couplable to an associated one of said upper jaw and said lower jaw;

a pair of second gripping surfaces, each of said second gripping surfaces being selectively couplable to an associated one of said upper jaw and said lower jaw;

a storage void extending into said pipe wrench, said storage void extending into said upper handle between said tool slot and said junction of said arms, each of said first gripping surfaces and said second gripping surfaces being selectively couplable to said pipe wrench in said storage void when not coupled to said upper jaw and said lower jaw;

a square aperture extending into said pipe wrench wherein said pipe wrench is configured for engaging and opening an oxygen tank, said square aperture being positioned on said upper jaw of said pipe wrench;

a pivot pin coupling said arms together;

an adjustment slot, said pivot pin extending through said adjustment slot wherein a distance between said upper jaw and said lower jaw is adjustable;

a bull pin coupled to and extending from a distal end of one of said upper handle and said lower handle relative to said upper and lower jaws, said bull pin being tapered extending away from said pipe wrench, said bull pin being coupled to and extending from said lower handle;

a plurality of connectors, each connector coupling an associated one of said first gripping surfaces and said second gripping surfaces to said pipe wrench; and a driving tool removably coupled to said pipe wrench, said driving tool being engageable to a selectable one of said connectors for coupling and uncoupling said first gripping surfaces and said second gripping surfaces to said pipe wrench.

* * * * *